US006705582B2

(12) United States Patent
Osborn

(10) Patent No.: US 6,705,582 B2
(45) Date of Patent: Mar. 16, 2004

(54) CONCRETE FORM & STAKE ASSEMBLY AND METHOD OF MAKING SAME

(76) Inventor: John Osborn, 1300 Bertram Rd., SE., Cedar Rapids, IA (US) 52403

( * ) Notice: Subject to any disclaimer, the term of this patent is extended or adjusted under 35 U.S.C. 154(b) by 0 days.

(21) Appl. No.: 09/941,460

(22) Filed: Aug. 29, 2001

(65) Prior Publication Data

US 2003/0042393 A1 Mar. 6, 2003

(51) Int. Cl.[7] ..... E04G 11/06; E01C 7/00; E01C 11/22

(52) U.S. Cl. ..... 249/6; 249/3; 249/33; 249/34; 249/189; 404/98; 52/274; 52/293.3

(58) Field of Search ..... 249/2–7, 9, 33, 249/34, 189, DIG. 3; 404/96, 98; 52/274, 293.1, 293.4, 309.11, 309.12, 309.13, 309.17

(56) References Cited

U.S. PATENT DOCUMENTS

| | | | | | |
|---|---|---|---|---|---|
| 939,071 | A | | 11/1909 | Ney | |
| 1,274,618 | A | * | 8/1918 | Smith | 249/3 |
| 1,345,179 | A | * | 6/1920 | Heltzel | 249/3 |
| 1,382,082 | A | * | 6/1921 | Heltzel | 249/6 |
| 1,756,514 | A | | 4/1930 | Hempstead | |
| 1,911,146 | A | * | 5/1933 | Diehl | 249/192 |
| 1,939,007 | A | | 12/1933 | Heltzel | |
| 2,793,416 | A | * | 5/1957 | Yearling | 249/6 |
| 3,405,905 | A | | 10/1968 | Dakin | |
| 3,771,757 | A | * | 11/1973 | Black | 249/219.2 |
| 3,785,606 | A | * | 1/1974 | Green | 249/3 |
| 3,797,800 | A | * | 3/1974 | Loy | 249/13 |
| 4,022,437 | A | * | 5/1977 | French | 249/3 |
| 4,121,804 | A | | 10/1978 | O'Leary | |
| 4,340,200 | A | | 7/1982 | Stegmeier | |

(List continued on next page.)

FOREIGN PATENT DOCUMENTS

| | | | | |
|---|---|---|---|---|
| GB | 2036155 | * | 6/1980 | 249/2 |

OTHER PUBLICATIONS

Jun. 1999 Product Brochure for Durand Forms, Footing Form System (including pictures).

Jun. 1998 Dee Streamlined Steel Forms and Stakes Brochure.

1999 Metal Forms Corp. Brochure.

Concrete Construction Article—Feb. 1990—Title: Flatwork Forming is a Snap Using Plastic Formwork System.

*Primary Examiner*—Jong-Suk (James) Lee
(74) *Attorney, Agent, or Firm*—Brian J. Laurenzo; Jason M. Hunt; Michael C. Gilchrist

(57) ABSTRACT

An assembly of concrete forms for use in the placement of concrete, the assembly having a pair of longitudinal form members and a ground engaging member that is in contact with at least one of the longitudinal form members. A first longitudinal form member slidably overlaps a second longitudinal form member such that the length of the combination of longitudinal form members is adjustable. Inverted U-shaped channels are provided at the top of each of the longitudinal form members which allow a male/female overlapping relationship and provide a location to receive the ground engaging member. A radius form member includes a longitudinal form member with a horizontal component or inverted U-shaped channel having successively spaced apart slots thereon, so that the radius form member is flexible. To create an angle, a corner forming bar is also provided for the assembly, extending between two of the longitudinal form members. A ground engaging member with a guide slot and locking mechanism is also provided for securing the longitudinal form members in place. A ground engaging member is provided for use with a footing. A method of forming the concrete form assembly is also disclosed.

11 Claims, 13 Drawing Sheets

U.S. PATENT DOCUMENTS 4,397,127 A * 8/1983 Mieyal ..... 52/241
4,533,112 A 8/1985 Santos, Jr. et al.
4,659,054 A * 4/1987 Allen ..... 249/7
4,750,703 A * 6/1988 Gentilcore et al. ..... 249/6
4,824,068 A * 4/1989 Ferland ..... 249/2
5,076,536 A * 12/1991 Fitzgerald ..... 249/219.1
5,079,884 A * 1/1992 Menchetti ..... 52/241
5,154,837 A * 10/1992 Jones ..... 249/2
5,174,083 A * 12/1992 Mussell ..... 249/5
5,343,667 A * 9/1994 Peden ..... 249/5 X
5,655,336 A 8/1997 Azar
5,927,038 A * 7/1999 Goldberg et al. ..... 52/632
6,021,994 A 2/2000 Shartzer, Jr.
6,158,710 A * 12/2000 Matthews ..... 249/34
6,332,599 B1 * 12/2001 Spartz ..... 249/34

* cited by examiner

CONCRETE FORM & STAKE ASSEMBLY AND METHOD OF MAKING SAME

BACKGROUND OF INVENTION

The invention relates to the field of concrete form work. In particular, the present invention provides a novel form, stake, and form assembly, and method of making the same, for use in the placement of concrete.

Concrete form and stake assemblies are used extensively for the placement of concrete in order to shape and contain the concrete, to create such things as sidewalks, driveways, footings, and concrete slabs. Preparation of a site for the placement of concrete, involves, after leveling off the area, erecting a frame to contain the concrete. Erecting the frame for concrete placement commonly involves: the placement of stakes; attaching the form members to the stakes by nailing the form into place; and ultimately forming a cavity within the completed assembly of forms into which concrete is placed. To cover a length larger than any one form, forms in the past have been abutted end-to-end to cover the additional length necessary. The concrete is placed into the cavity within this frame. The frame is then removed once the concrete has set.

Frames erected for the placement of concrete conventionally are constructed of lumber. Often, in order to accommodate the various dimensions of frames, the lumber must be cut to shorter lengths to accommodate specific projects, making it unlikely the lumber will be used on a subsequent project of differing dimensions. Further, the necessary nailing or other means of attaching the wooden forms to the stakes results in damage to the lumber—the end result being that the lumber is likely consumed in the placement of one slab of concrete. Another problem with using lumber is that it does not bend well to form a radius. As a result, other materials may be necessary to form a radius or significant time is expended in shaping the wood. Furthermore, because concrete tends to stick to the wood, the wood forms cannot be removed at the end of the day. Instead, the worker must return on a second day to retrieve the forms after the concrete has sufficiently set.

Some alternatives to wooden forms have been used. One such alternative is to use a flexible plastic form. These forms have the ability to flex to accommodate various grades of land and to accommodate slight curves. However, to accommodate lengths longer than any one form, the plastic forms are abutted end-to-end. Thus, in order to accommodate a specific length it may be necessary to purchase a specific length form or to cut a form to the specific length, both of which are inefficient and costly.

One solution to the drawbacks of both the wooden and plastic forms has been to provide a metal formwork board that will not be consumed during one project and can therefore be used in subsequent projects. Traditionally, these metal formwork boards were abutted end-to-end, as was the case with the wooden forms, to accommodate lengths longer than a single form board. However, the problem with such an assembly is that without specific lengths of metal forms, it is difficult to modify the forms to accommodate the various lengths necessary to build an appropriate size frame.

Thus, as disclosed in U.S. Pat. No. 5,655,336, one attempt to accommodate specific length frame sizes was to use a telescopic metal form board that extends to various lengths. As a telescopic form, the form can be expanded to a desired length within a limited range to accommodate various frame sizes. A problem with telescopic frames is, however, that the frames are generally of a C-shaped cross-section and consist of successively smaller C-shaped components fitting within a larger C-shaped component. Due to the C-shape and function of the telescopic components, the successive telescopic forms must be either abutted end-to-end or slid within each other to accommodate lengths greater than any one telescopic form. As a result, the assembly and disassembly of the forms, particularly for forms that are slid within one another, requires sliding the C-shapes together or apart before securing the forms in place. Unless these forms are kept extremely clean, the C-shape forms will not slide within one another, adding unwanted additional time and energy for a worker to thoroughly clean the form and to slide the forms together before securing the form to the ground. These forms, due to the C-shaped cross-section cannot be used to create a radius, or curved portion for the frame. Furthermore, the telescopic forms are quite bulky, due to the series of components that must be slid within one another, requiring significant space for transport and storage, as well as adding additional weight. Additionally, the C-shape of these forms is difficult to manufacture.

Problems also exist with respect to the stakes and the structure for securing the stakes to the form boards. Various types of stakes and methods of securing the stakes to the form boards have been used to secure the form boards in place on the ground. For example, simple metal stakes of various lengths have been used. These stakes are driven into the ground, and often have holes drilled through them so as to allow a nail to be driven through the stake and into the wooden form board to secure the board in place. Wooden stakes could also be used with nails driven through them and into the form boards to secure the forms in place. Alternative stake systems that have been used consist of holes vertically spaced throughout the form members so that a stake may be inserted into the hole and subsequently driven into the ground to secure the form in place, or alternatively, using a clip or other means to attach the stake at the outside of the form member.

The problems with these prior stakes are various. First of all, stakes that require nails to be driven through same result in damage to the form boards as already discussed. Furthermore, these stakes require the worker to have additional materials available while constructing the frame. Stakes that require vertically driven holes in the forms require that the stakes be placed in certain exact locations, not allowing for the adjustments needed for variations in terrain or other factors. Additionally, for those telescopic forms that require the stake to be driven through the form member, the placement of the holes in the form boards limits the distances the form boards can be extended in order to insert the stakes through the forms. Finally, for stakes that are set to the side of the forms, two problems arise. First, the weight of the forms is not balanced properly on the stake, resulting, if the stake is not driven in far enough, in the possibility that the form and stake assembly may lean to one side. Second, the side attachments for the stakes are additional components that the worker must carry and have available for assembly of the frame, creating additional set-up time, the requirement of more storage space, and more items to transport.

Furthermore, the above described stakes are not adequate to be used simultaneously for placement of concrete in a trench footing and the creation of a concrete slab. Prior stakes typically are straight, not including any angles or offset, resulting in the attachment of a concrete form board directly above the location of placement of the stake into the ground. Typically, in creation of a footing, a trench is first formed and concrete is placed into the trench. Subsequently, the concrete slab is created above the filled trench by the use of concrete form members and stakes. However, this is a two step process, requiring additional time and materials. To limit this to a single step process the above-mentioned stakes are placed into the ground prior to filling the trench. The result is that the side wall of the trench is likely to collapse due to the close proximity of the stake to the trench to create a concrete slab above the footing. Therefore, to create a trench footing simultaneously with the creation of a concrete slab, an offset is needed in the stake to provide space between the wall of the trench and the location of insertion of the stake into the ground to avoid this problem of trench cave in.

In view of the foregoing, therefore, a need exists for a concrete form assembly that is light weight, easy to clean, easy to manufacture, reusable, easy and quick to assemble and disassemble, and capable of conforming to any length, for use with a ground engaging member that does not result in damage to the form, is simple to use, and comprises few parts. A need also exists for radius forms to be used with such an assembly, and for stakes for use in the creation of a trench footing simultaneously with the creation of a concrete slab without the cost of additional materials or time.

The difficulties encountered in the prior art are substantially eliminated by the present invention.

SUMMARY OF THE INVENTION

An object of the present invention is to provide a novel form, stake, and form assembly for use in the placement of concrete.

A second object of the present invention comprises form members that overlap one another, allowing simple and quick assembly and disassembly of the concrete form and stake assembly.

A third object of the present invention comprises form members that overlap so as to adjust to any length necessary for frames of a particular dimension.

Another object of the present invention is to provide thin concrete form members so that the forms may be overlapped without forming a significant ridge on the concrete face of the form.

A further object of the present invention comprises overlapping metal forms that are easy to clean, but still function effectively with debris remaining on the form.

An additional object of the present invention comprises concrete form members that are light weight, and thin, to accommodate easy and compact storage and transport.

A still further object of the present invention comprises radius form members that function in the same manner as non-radius forms, yet provide the ability to flex or bend in either direction.

One more object of the present invention comprises stakes that fit functionally within an extension of a concrete form member for resting the form on the stake and for easy assembly and disassembly of the concrete form and stake assembly.

Another object of the present invention comprises ground engaging members that have attached locking mechanisms to provide for securing the ground engaging member in place without separate additional materials.

A further object of the present invention comprises providing a novel stake for use with a footing.

By the present invention, it is proposed to overcome the difficulties encountered heretofore. To this end, an assembly for concrete forms for use in the placement of concrete, in which the concrete forms are light weight, easy to manufacture, easy to clean, and capable of being stacked in a compact fashion, is provided. The concrete form assembly comprises a first longitudinal form member with a first end and a second end; a second longitudinal form member with a first end and a second end; a ground engaging member in contact with at least one of the first and second longitudinal form members; and the second end of the first longitudinal form member slidably overlapping the first end of the second longitudinal form member, allowing the combination of first and second overlapping longitudinal form members to be adjusted for length by varying the amount of longitudinal overlap.

These and other objects will become apparent upon reference to the following specification, drawings, and claims.

DETAILED DESCRIPTION OF PREFERRED EMBODIMENTS

Figure 1:
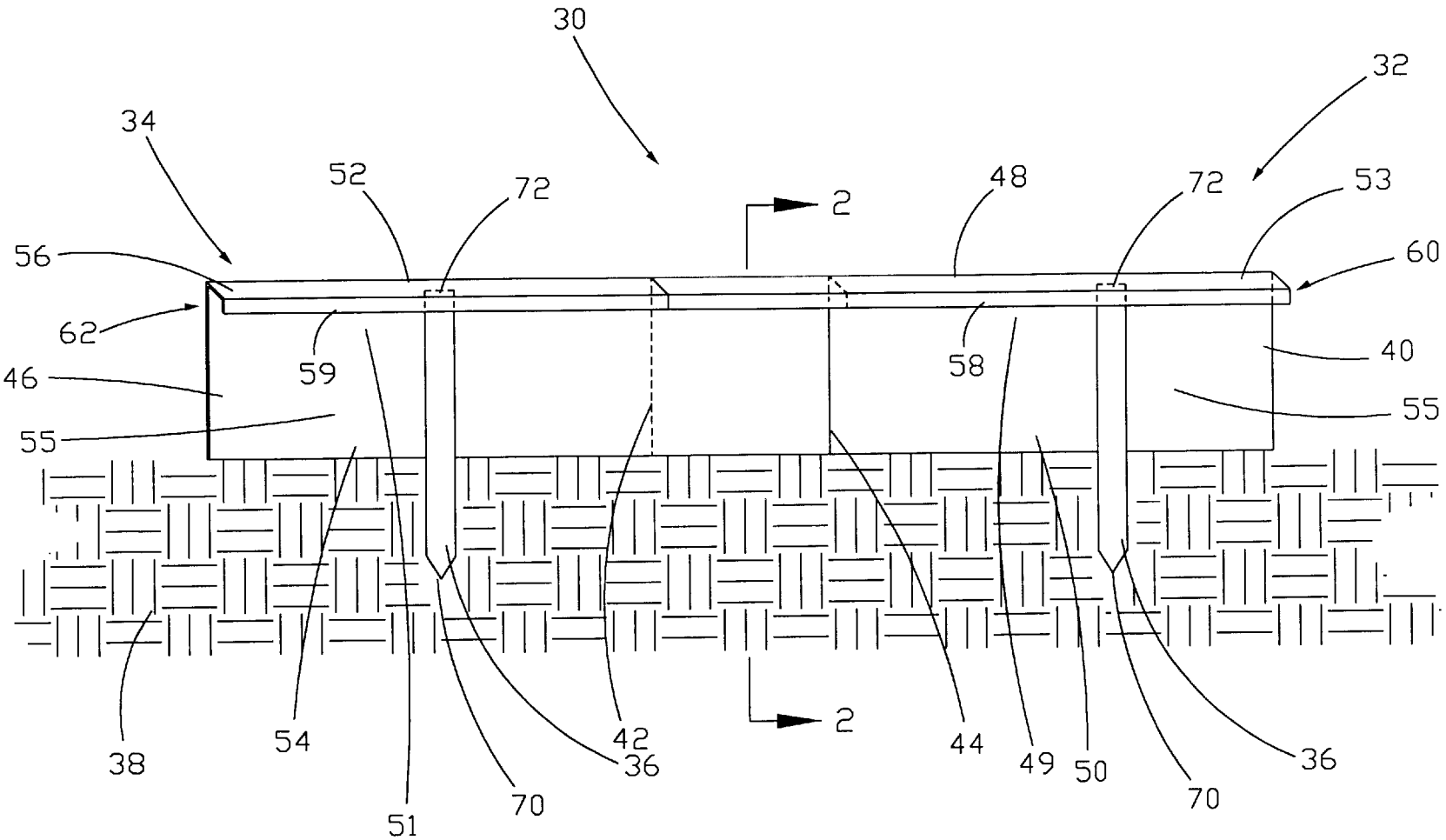
FIG. 1 shows a perspective view of a preferred embodiment of the assembly of the present invention.

The Figures show an assembly of concrete forms 30 for use in the placement of concrete, in which the concrete form members 32, 34 are light weight, easy to manufacture, easy to clean, and capable of being stacked in a compact fashion. The concrete form members 32, 34, due to the thinness of the form material used, are capable of being stacked in a compact fashion (see FIG. 4) for both transport and storage. The assembly of concrete forms 30 has a first longitudinal form member 32 (see FIGS. 1 & 2), a second longitudinal form member 34 engaging the first longitudinal form member 32 so that the first longitudinal form member 32 slidably overlaps the second longitudinal form member 34, allowing the combination of the first 32 and second 34 longitudinal form members to be adjusted for length by varying the amount of longitudinal overlap (see FIGS. 6 & 7), and at least one ground engaging member 36 is also present that is both in contact with at least one of the first 32 and second 34 longitudinal form members and in contact with the ground 38.

Figure 4:
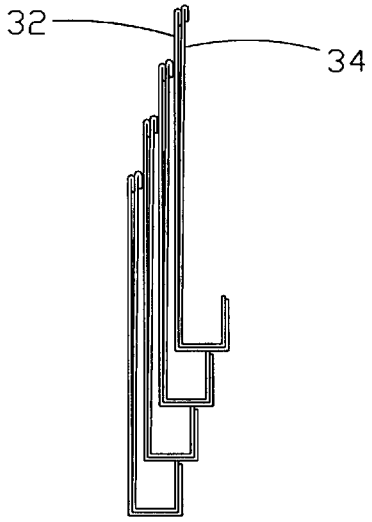
FIG. 4 shows an end elevational view of several concrete form members stacked together for transport and storage.

The first longitudinal form member 32 and the second longitudinal form member 34 in a preferred embodiment are constructed of 18-gauge galvanized steel, although it is contemplated by this invention that other types of metal, such as for example, stainless steel, steel with epoxy resin overlay, or aluminum, and gauges of metal, such as 16-gauge galvanized steel, may be used, as well as other materials, such as plastic or wood shaped as the forms of the present invention. In a preferred embodiment each longitudinal form member is ten (10) feet in length. Although those of ordinary skill in the art will understand that any length longitudinal form member is functional with the assembly 30. As a steel form, concrete does not stick to the form as much as the wood forms of the prior art, and therefore the form is easier to clean and can be removed from the assembly much sooner than wood. More particularly, at the end of the day, after the concrete has been placed, the worker may remove the concrete form members. Therefore, a return trip to the job site at a later date to remove the forms is often not required. Secondly, as a thin gauge of metal, the forms are relatively light weight and capable of being stacked in a compact fashion (FIG. 4). In a preferred embodiment, up to twenty (20) forms can be stacked and carried at once. Furthermore, as a thin steel form with very few bends or extensions, the longitudinal form members are easy to manufacture.

Figure 8:
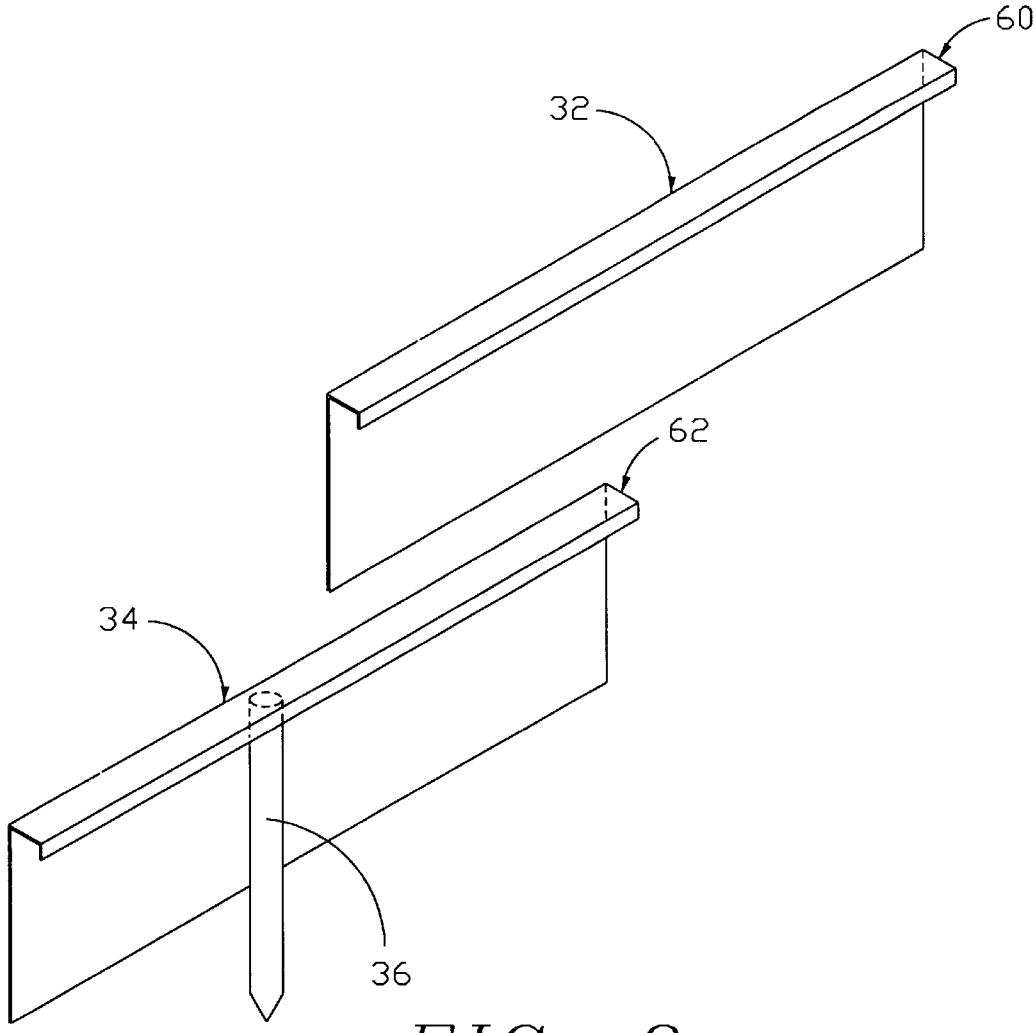
FIG. 8 shows a perspective view of the assembly of FIG. 1, showing the top overlapping concrete form member lifted off of the lower concrete form member.
Figure 9:
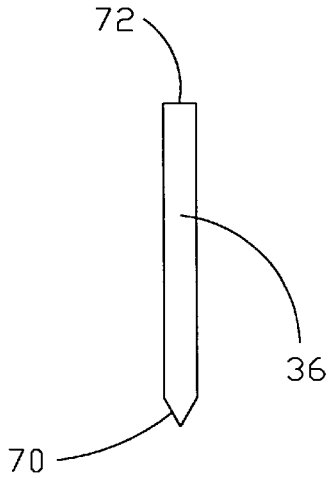
FIG. 9 shows a side elevational view of the ground engaging member of the present invention.

As best seen in FIG. 8, the first longitudinal from member 32 has a first end 40 and a second end 42, and a top portion 48 and a bottom portion 50. Similarly, the second longitudinal form member 34 has a first end 44 and a second end 46, and a top portion 52 and a bottom portion 54. In each of the first 32 and second 34 longitudinal form members, a forming component 55 is present. The forming component 55 has a face 57 that, when the concrete is placed into the frame, faces and is in contact with the concrete. This forming component 55 can be varied in height by using different forms to accommodate different depths of concrete. A preferred embodiment uses varying heights of two (2) inches to ten (10) inches, generally 2, 4, 6, 8, 10 inches, though those of ordinary skill in the art will understand that the exact measurements are not crucial.

Extending from the top portion 48, 52 of each of the first 32 and second 34 longitudinal form members is a horizontal component 53, 56 with a downward extension 58, 59 forming an inverted U-shaped channel 60, 62 on each of the longitudinal form members. In a preferred embodiment, the horizontal component 53, 56 for each respective form member is the equivalent width of the associated downward extension 58, 59 of each respective form. However, those of ordinary skill in the art will understand that the exact measurements are not crucial, so long as a downward extension 58, 59 exists to create an inverted U-shaped channel. More specifically, each longitudinal form member has four frame elements: a generally vertical first frame element or downward extension 58, 59; a generally horizontal second frame element, or horizontal component 53, 56; a generally vertical third frame element or upper vertical section 49, 51; and a generally vertical fourth frame element or lower vertical section 50, 54. These four sections are interconnected, forming the respective longitudinal form members 32, 34. Particularly, the first frame element 58, 59 is integrally connected with the second frame element 53, 56 so that the first frame element 58, 59 extends below the second frame element 53, 56. The opposing end of the second frame element 53, 56 is integrally connected to the third frame element 49, 51, which also extends below the second frame element 53, 56, resulting in the second frame element 53, 56 positioned between the first frame element 58, 59 and the third frame element 49, 51. Finally, the fourth frame element 50, 54, or bottom portion of the longitudinal form member 42, 34, is connected to the third frame element 49, 51. The fourth frame element 50, 54 extends axially below the third frame element 49, 51 so that it extends beyond the length of the first frame element 58, 59. The combination of the first frame element 58, 59, the second frame element 53, 56, and the third frame element 49, 51 forms the inverted U-shaped channel 60, 62.

Figure 2:
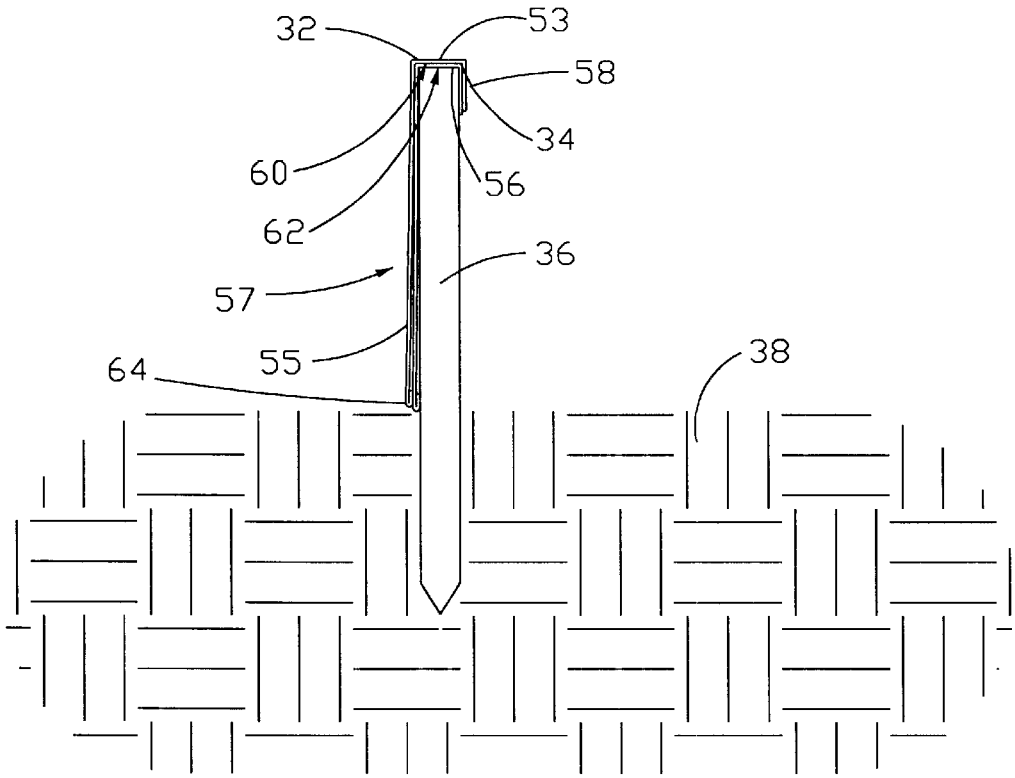
FIG. 2 shows a cross-sectional view of the assembly of FIG. 1 along axis 2—2.

Furthermore, in one embodiment the longitudinal form member 32, 34 includes a stiffener 64, at the bottom portion 50, 54 of the concrete form member to decrease the flexibility of the thin metal form (See FIG. 2). This stiffener 64 in a preferred embodiment is typically either material added to the thin metal longitudinal form member 32, 34, or a folding-over of the bottom portion 50, 54 of the longitudinal form member 32, 34, which strengthens the form and reduces the flexibility. This addition of the stiffener 64 is done so as to not interfere with the overlapping of the longitudinal form members 32, 34. In other words, the advantages created by the thinness of the first 32 and second 34 longitudinal form members are retained.

Figure 3:
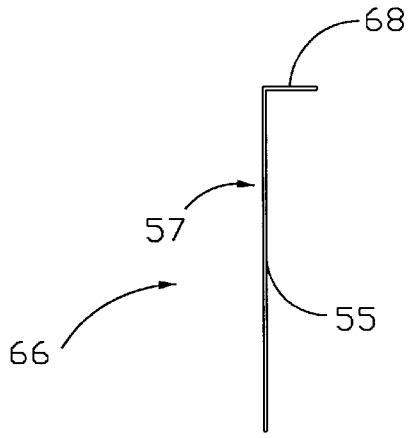
FIG. 3 shows a cross-sectional view of an alternative embodiment of a concrete form member with an inverted L-shaped cross-section.

The inverted U-shaped channels 60, 62 are of slightly different widths (FIG. 2). The first inverted U-shaped channel 60, extending from the first longitudinal form member 32, is of a slightly larger width than the second inverted U-shaped channel 62, extending from the second longitudinal form member 34, so that the second longitudinal form member 34 fits slidably within the first longitudinal form member 32 in a male/female relationship (FIGS. 1 & 2). More specifically, the horizontal component 53 of the first longitudinal form member 32 is of a greater width than the horizontal component 56 of the second longitudinal form member 34. As a result, the second end 42 of the first longitudinal form member 32 can be matingly and slidably overlapped with the first end 44 of the second longitudinal form member 34, allowing the form members to be adjusted for varying frame lengths by sliding the longitudinal form members or lifting the first longitudinal form member 32 off of the second longitudinal form member 34 (FIG. 8) and repositioning it, so as to vary the amount of longitudinal overlap. Similarly, the lifting off and/or repositioning of the first longitudinal form member 32 provides for quick assembly and disassembly of the frame. Furthermore, this male/female relationship provides for a close engagement between the first 32 and second 34 longitudinal form members so that no sizeable ridge on the concrete face is created from the overlap of forms. Alternatively, the first and second longitudinal form members could be of an inverted L-shaped cross-section 66 (see FIG. 3), in which there would be no need for varying the width of the horizontal extension 68. Instead, the form members would simply be overlapped so that the horizontal extensions 68 would rest upon the top of one another.

Figure 5:
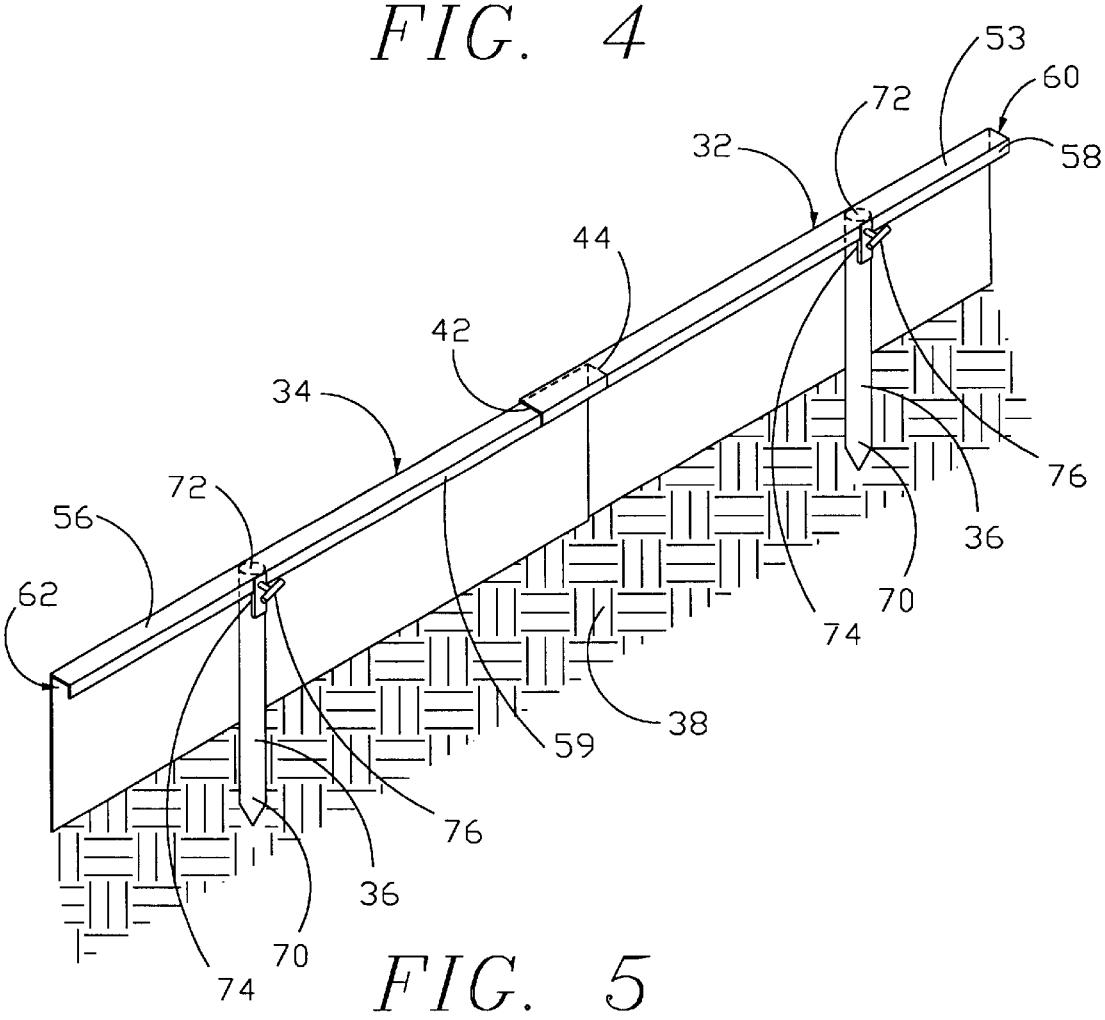
FIG. 5 shows a perspective view of the assembly of FIG. 1 with the ground engaging member having a guide slot and locking mechanism thereon.

The inverted U-shaped channel 60, 62 of either the first longitudinal form member 32 or the second longitudinal form member 34 receives a ground engaging member 36 (FIGS. 2 & 5). The ground engaging member 36 is of a sufficient width or diameter so that it fits within the narrower inverted U-shaped channel 62 of the second longitudinal form member 34. In a preferred embodiment, the ground engaging member is a one (1) inch round stake. It is also contemplated that any stake currently used in the art upon which the form members could sit is functional with the assembly. Furthermore, the ground engaging end 70 of the ground engaging member 36 is in contact with the ground 38. Preferably, the ground engaging end 70 is inserted or pounded into the ground 38. Alternatively, it is contemplated that a ground engaging member could be used in which the ground engaging member is not inserted into the ground, but in contact with the surface of the ground, using a wide flat base or a weighted base to prevent the ground engaging member from moving. The form engaging end 72 of the ground engaging member is in contact with one of the horizontal components 53, 56 of either inverted U-shaped channel 60, 62. As a result, the longitudinal form members 32, 34 are supported by the contact between the horizontal component 56 and the ground engaging member 36, and, therefore hang from the ground engaging member. This hanging of the longitudinal form member allows for quick assembly and disassembly of the concrete form and stake assembly because there is no need to nail anything in place or to attach any locking devices to the form or ground engaging member. It is noted that the second longitudinal from member 34 and its horizontal component 56 are used here merely for illustrative purposes, and the equivalent contact and support is also possible for the first longitudinal form member 32 with horizontal component 53, when placed in contact with the ground engaging member 36.

Figure 10:
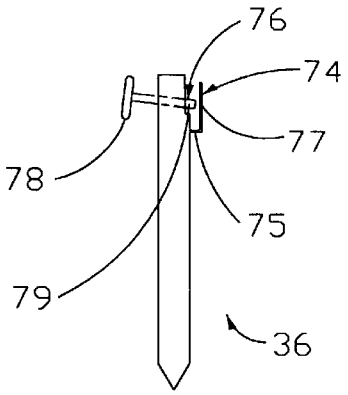
FIG. 10 shows a side elevational view of an alternative embodiment of the ground engaging member, including a guide slot and tightening means, in which the tightening means extends through the ground engaging member.

Alternatively, an embodiment of the ground engaging member 36 with an attached guide slot 74 and locking mechanism 76 for securing either of the longitudinal form members 32, 34 in place on the ground engaging member 36 is provided (FIGS. 10–14). The guide slot 74 comprises a horizontal extension 75 that extends from the ground engaging member 36 and has at the end of the horizontal extension 75 opposite the ground engaging member 36 a vertical lip 77 extending above the horizontal extension 75. The combination of horizontal extension 75 and vertical lip 77 forms a channel, or guide slot 74, that is capable of receiving at least one of the longitudinal form members. In one embodiment, as shown in FIG. 10, the form engaging end 72 of the ground engaging member 36 is milled down to provide a better fit with the longitudinal form member. Generally, the guide slot and locking mechanism provide the advantage of the ability to secure the forms without the need for additional materials and without damaging the forms.

An embodiment of the locking mechanism 76 comprises, as shown in FIG. 10, a tightening means 78, such as for example a screw, that extends through the ground engaging member 36. Other possible tightening means are a screw extending through the guide slot 74, a bent rod 69, a cam type lever 80, a hammer tapered wedge, a tapered friction fit device, or other tightening means known in the art. The guide slot 74 and locking mechanism 76 function by one of the longitudinal form members 32, 34, preferably the longitudinal form member that receives the ground engaging member 36, mating with the guide slot 74 and locking in place with the locking mechanism 76. More particularly, the locking mechanism 76 functions by inserting the forming component 55 of one of the longitudinal form members 32, 34 into the guide slot 74 for the ground engaging member 36, then tightening, for example, the screw 78, which extends through the ground engaging member 36, so that the threaded end 79 of the screw 78 presses against the forming component 55 of the form member, wedging the forming component 55 between the guide slot 74 and the tightening means 78.

Figure 11:
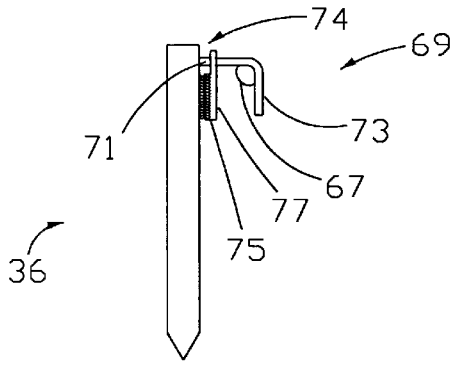
FIG. 11 shows a side elevational view of an alternative embodiment of the ground engaging member, including a guide slot and tightening means, in which the tightening means is a bent rod.

A preferred embodiment of the ground engaging member 36 with attached guide slot 74 and locking mechanism 76 is shown in FIG. 11. In this embodiment, the locking mechanism 76 is an bent rod 69. This bent rod 79 is threaded similar to a screw, and has a form contact end 71 which extends through the vertical lip 77 of the guide slot 74, an operational end 73, and a rod angle 67 between the form contact end 71 and the operational end 73. The bent rod 69 locking mechanism functions by inserting the form engaging end 72 of the ground engaging member 36 into the inverted U-shaped channel 60, 62 of either longitudinal form member 32, 34, the downward extension 58, 59 of either inverted U-shape channel 60, 62 inserting into the guide slot 74. Subsequently, the operational end 73 of the bent rod 69 is rotated so as to bias the downward extension 58, 59 between the form contact end 71 of the bent rod 69 and the ground engaging member 36.

Figure 12:
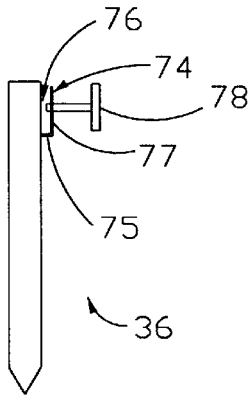
FIG. 12 shows a side elevational view of an alternative embodiment of the ground engaging member, including a guide slot and tightening means, in which the tightening means extends through the guide slot.
Figure 14:
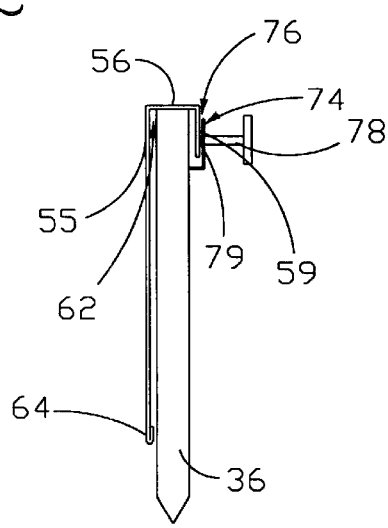
FIG. 14 shows a cross-sectional view of a concrete form member received within the guide slot and locked with the tightening means shown in FIG. 12.

A third embodiment of the locking mechanism 76 includes, as shown in FIGS. 12 & 14, a tightening means, or screw 78, as described above, that extends through the guide slot 74 of the ground engaging member 36. This locking mechanism 76 functions by inserting the downward extending portion 58, 59 of either inverted U-shaped channel 60, 62 into the guide slot 74 of the ground engaging member 36, then tightening the tightening means 78 so that the threaded end 79 of the screw 78 presses against the downward extending portion 58, 59 of either inverted U-shaped channel 60, 62, wedging the downward extending portion 58, 59 of the inverted U-shaped channel between the ground engaging member 36 and the tightening means 78. Alternatively, the forming component 55 of one of the longitudinal form members 32, 34 may be inserted within the guide slot 74 and locked in place in the same manner.

Figure 13:
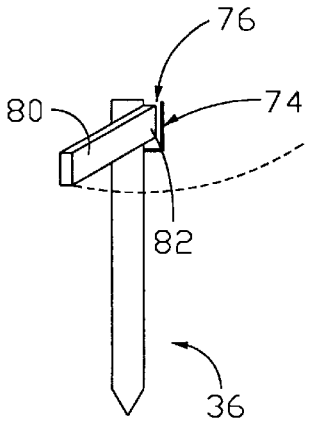
FIG. 13 shows a side elevational view of an alternative embodiment of the ground engaging member with a guide slot and cam type lever.

A fourth embodiment of the locking mechanism involves, as shown in FIG. 13, a cam type lever 80. The cam type lever 80 functions by inserting the downward extending portion 58 of either of the inverted U-shaped channels 60, 62, or the forming component 55 of one of the longitudinal form members 32, 34, into the guide slot 74, then rotating the lever 80 away from the stake into the engaging position, which in turn causes the downward extending portion 58, 59 of an inverted U-shaped channel 60, 62 or the forming component 55 of the longitudinal form member 32, 34, whichever is inserted into the guide slot 74 of the ground engaging member 36, to be biased against the guide slot 74 between the form engaging end 82 of the cam type lever 80 and the guide slot 74.

It is further contemplated that the guide slot 74 could be used without a locking mechanism 76 or without tightening the locking mechanism 76. Alternatively, a locking mechanism 76 might be used without the guide slot 74. Furthermore, the guide slot 74 could operate by receiving both of the longitudinal form members 32, 34 or their inverted U-shaped channels 60, 62.

Figure 15:
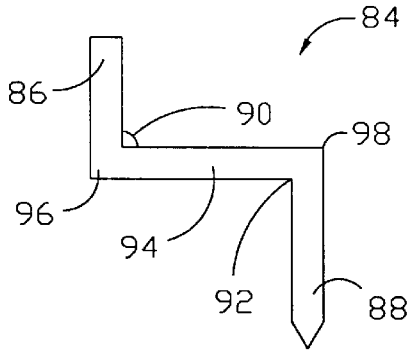
FIG. 15 shows a side elevational view of the ground engaging member for use with a footing.
Figure 16:
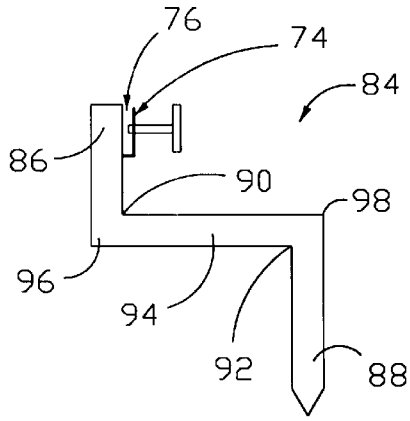
FIG. 16 shows a side elevational view of an alternative embodiment of the ground engaging member for use with a footing, including a guide slot and locking mechanism thereon.
Figure 17:
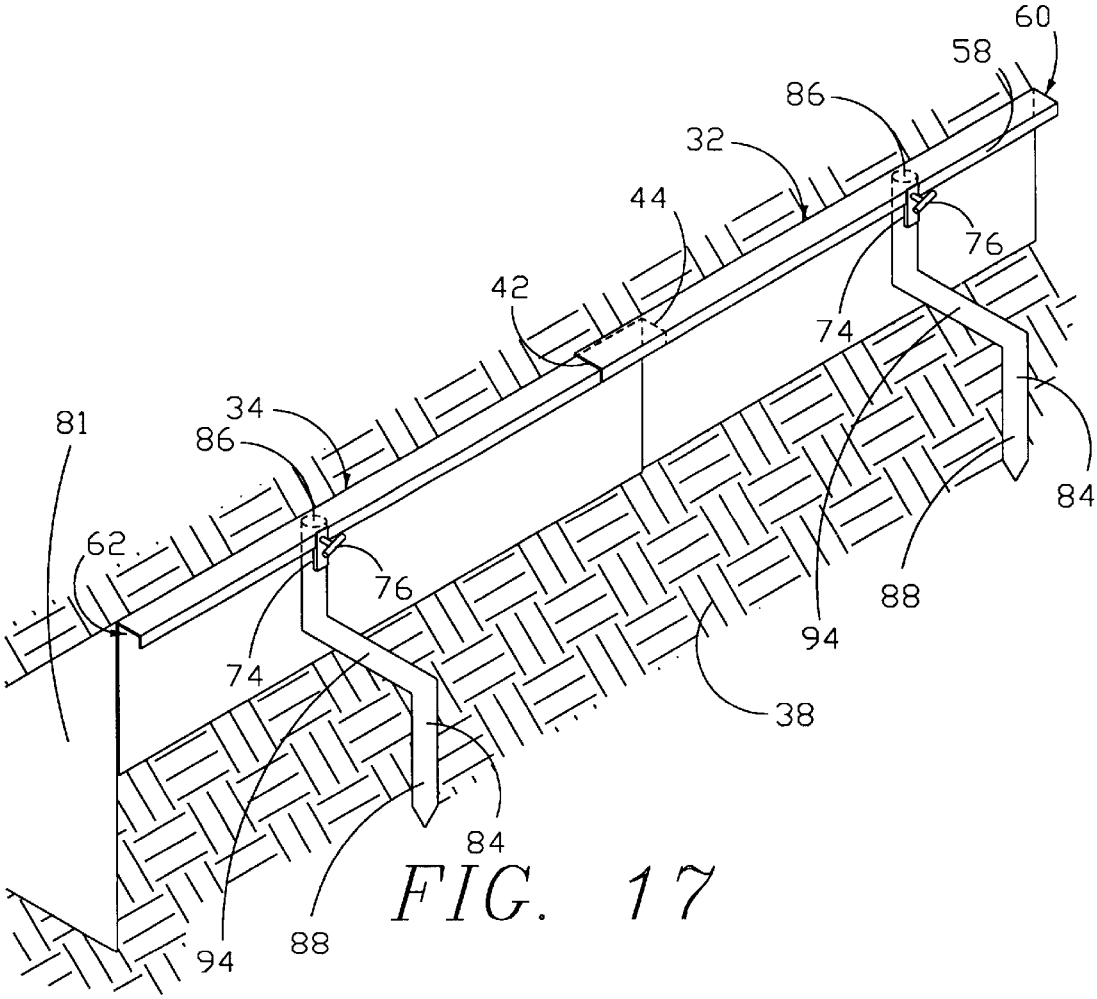
FIG. 17 shows a perspective view of the assembly of the present invention, including a ground engaging member for use with a footing.

An additional embodiment of the ground engaging member 36 is an offset ground engaging member 84 for use when placing concrete into a trench 81 to create a footing simultaneously with the creation of a concrete slab (FIGS. 15–17). While it is not necessary to use this offset ground engaging member 84 with the concrete form assembly 30, the offset ground engaging member 84 is functional with the assembly 30 (FIG. 17). The offset ground engaging member 84 includes a top portion 86, or form engaging arm, which is placed in contact with one of the longitudinal form members; an offset arm 94 connected to the form engaging arm 86 at the offset side 96 of the offset arm 94; and a bottom portion 88, the ground engaging arm, which is connected to the offset arm 94 at the ground engaging side 98 of the offset arm 94, and which ground engaging arm 88 is placed in contact with the ground 38.

In a preferred embodiment of the offset ground engaging member 84, the offset arm 94 is substantially perpendicular to the form engaging arm 86 and includes a first angle 90. The first angle 90 is generally a ninety (90) degree angle formed between the offset arm 94, which is substantially horizontal, and the form engaging arm 86. The form engaging arm 86 is substantially vertical, therefore the first angle 90 is formed above the offset arm 94 when the ground engaging arm 88 of the offset ground engaging member 84 is in contact with the ground 38. The offset ground engaging member 84 also includes a second angle 92. The second angle 92 is generally a ninety (90) degree angle formed between the offset arm 94 and the ground engaging arm 88. The ground engaging arm 88 is substantially vertical, therefore the second angle 92 is formed below the offset arm 94 when the ground engaging arm 88 of the offset ground engaging member 84 is in contact with the ground 38. As a result of the first angle 90 and the second angle 92, the form engaging arm 86 is offset from the ground engaging arm 88, and when the ground engaging arm 88 of the offset ground engaging member 84 is placed in contact with the ground 36, the first 32 or second 34 longitudinal form member in contact with the form engaging arm 86 will be offset from the location of contact of the offset ground engaging member 84 with the ground 38 (see FIG. 17). Alternatively, this offset ground engaging member 84 can be used with the guide slot 74 and any of the locking mechanisms previously described. As a result, the offset provides for the creation of a trench footing simultaneously with the creation of a concrete slab above the footing without additional time or materials.

Figure 19:
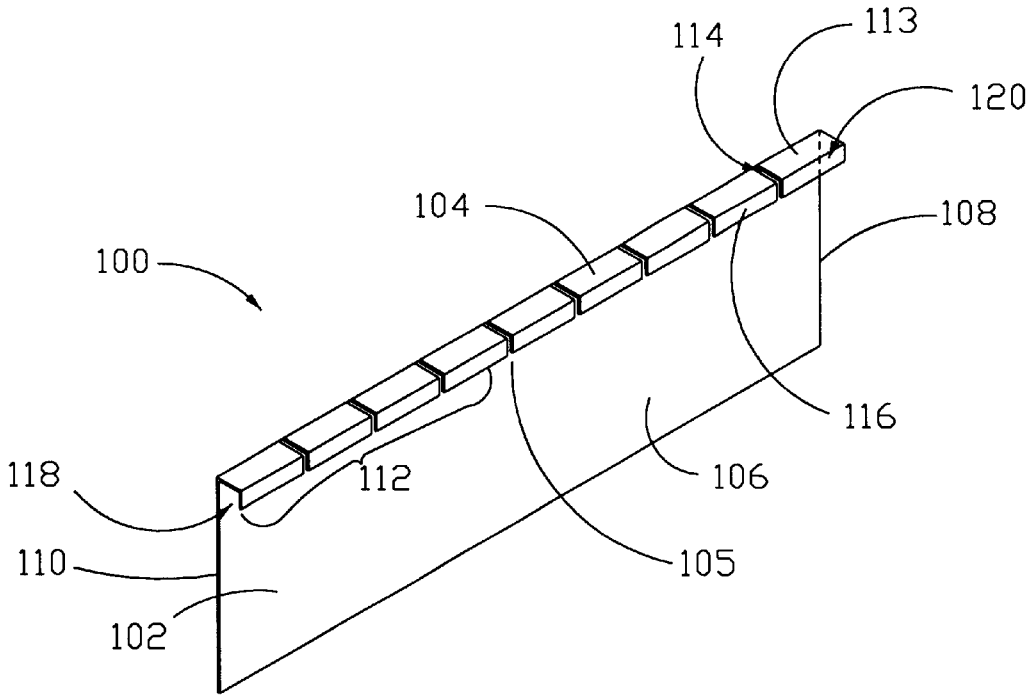
FIG. 19 shows a perspective view of a radius concrete form member.
Figure 20:
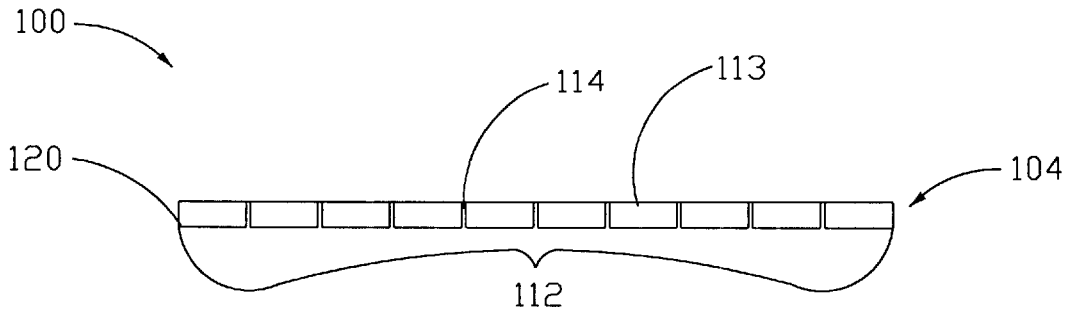
FIG. 20 shows a top plan view of a radius concrete form member that is straight.

In creating an assembly of concrete forms for use in the placement of concrete it is often necessary to include a radius form to accommodate curved portions of the frame. Therefore, it is advantageous to have a radius form member compatible and functional with the concrete form and stake assembly that requires minimal additional time and materials. This radius form member would be used in place of a longitudinal form member 32, 34, or in addition to the assembly 30. Therefore, a radius form member 100 functional with the present invention is provided (FIG. 19), which can be used as an alternative to either longitudinal form member 32, 34, or in addition to the assembly 30 of these longitudinal form members.

The radius form member 100 includes a forming component 102 equivalent to the forming component 55 of the first 32 and second 34 longitudinal form members, an upper vertical section 104, a lower vertical section 106 extending axially below the upper vertical section 104, a first end 108 and a second end 110. From the upper vertical section 104 of the radius form member 100 extends a plurality of horizontal extensions 112 spaced evenly apart along the upper vertical section 104 from the first end 108 of the radius form member 100 to the second end 110. The series of individual horizontal extensions 113 are spaced apart so that alternating between individual horizontal extensions 113 are spaces with no material, or slots 114. Furthermore, downward extending lips 116 extend from the individual horizontal components 113, so that the slots 114 are maintained between the horizontal extensions 113 with attached downward extending lips 116. These horizontal extensions 113 with attached downward extending lips 116 in combination with the upper vertical section 104 form an inverted U-shaped channel 118 extending from the first end 108 to the second end 110 of the radius form member 100 with a plurality of spaced apart slots 114. As a result of this plurality of spaced apart slots, the radius form member 100 is bendable or flexible. It is further contemplated that a single slot 114 could be used to provide the necessary flexibility.

Figure 18:
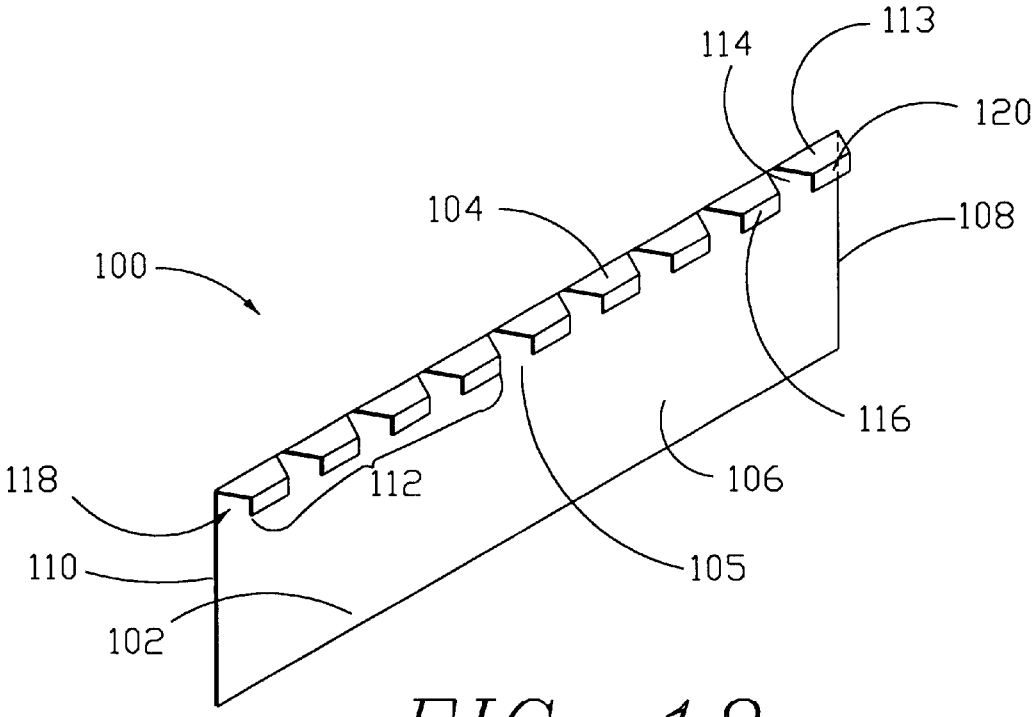
FIG. 18 shows a perspective view of an embodiment of the radius concrete form member with tapered horizontal extensions.

Radius form members with different width inverted U-shaped channels 118 are provided, to allow a radius form member 100 to be used in an overlapping relationship with either the first longitudinal form member 32 or the second longitudinal form member 34. In an alternative embodiment of the radius form member 100 no downward extending lip 116 is present, creating an inverted L-shape cross section for the radius form member. It is also contemplated that a form with no horizontal extensions 113 could be used to create a radius. Alternatively, the horizontal extensions 113 could be tapered at the end furthest from the forming component 102 of the radius form member 100, to provide a greater degree of flexibility for the radius form member 100 (FIG. 18).

The plurality of spaced apart slots 114 on the inverted U-shaped channel 118 of the radius form member 100 (FIG.

Figure 21:
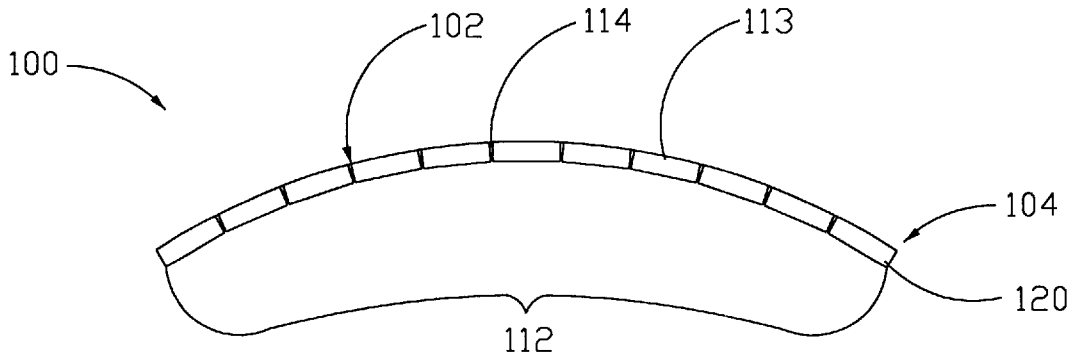
FIG. 21 shows a top plan view of the radius concrete form member of FIG. 20, curved in an inward direction.
Figure 22:
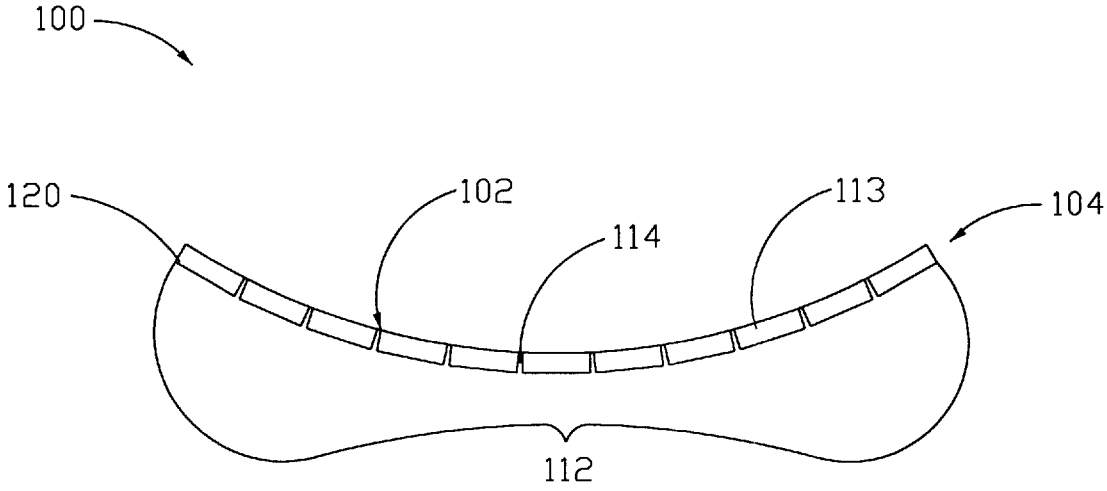
FIG. 22 shows a top plan view of the radius concrete form member of FIG. 20, curved in an outward direction.

20) or even a single slot 114 on the inverted U-shaped channel 118, allows the radius form member to be bent or flexed around a vertical axis. To form the inward bend of a curve, as shown in FIG. 21, the radius form member 100 is flexed so that the outer edges 120 of the individual successively spaced apart horizontal extensions 113 move closer together as the radius becomes smaller. At its smallest, the radius form member 100 is flexed so that the outer edges 120 of the plurality of individual spaced apart horizontal components 113 are in contact with one another, in a preferred embodiment, this radius is a twelve (12) inch radius. The radius form member 100 may also be flexed in the opposite direction, forming the outward bend of a curve (see FIG. 22). In forming the outward bend of a curve, the radius form member 100 is flexed so that the outer edges 120 of the individual spaced apart horizontal extensions 113 move further and further apart, the maximum point of the outward bend being the point at which the forming component 102 of the radius form member 100 can no longer flex.

Figure 23:
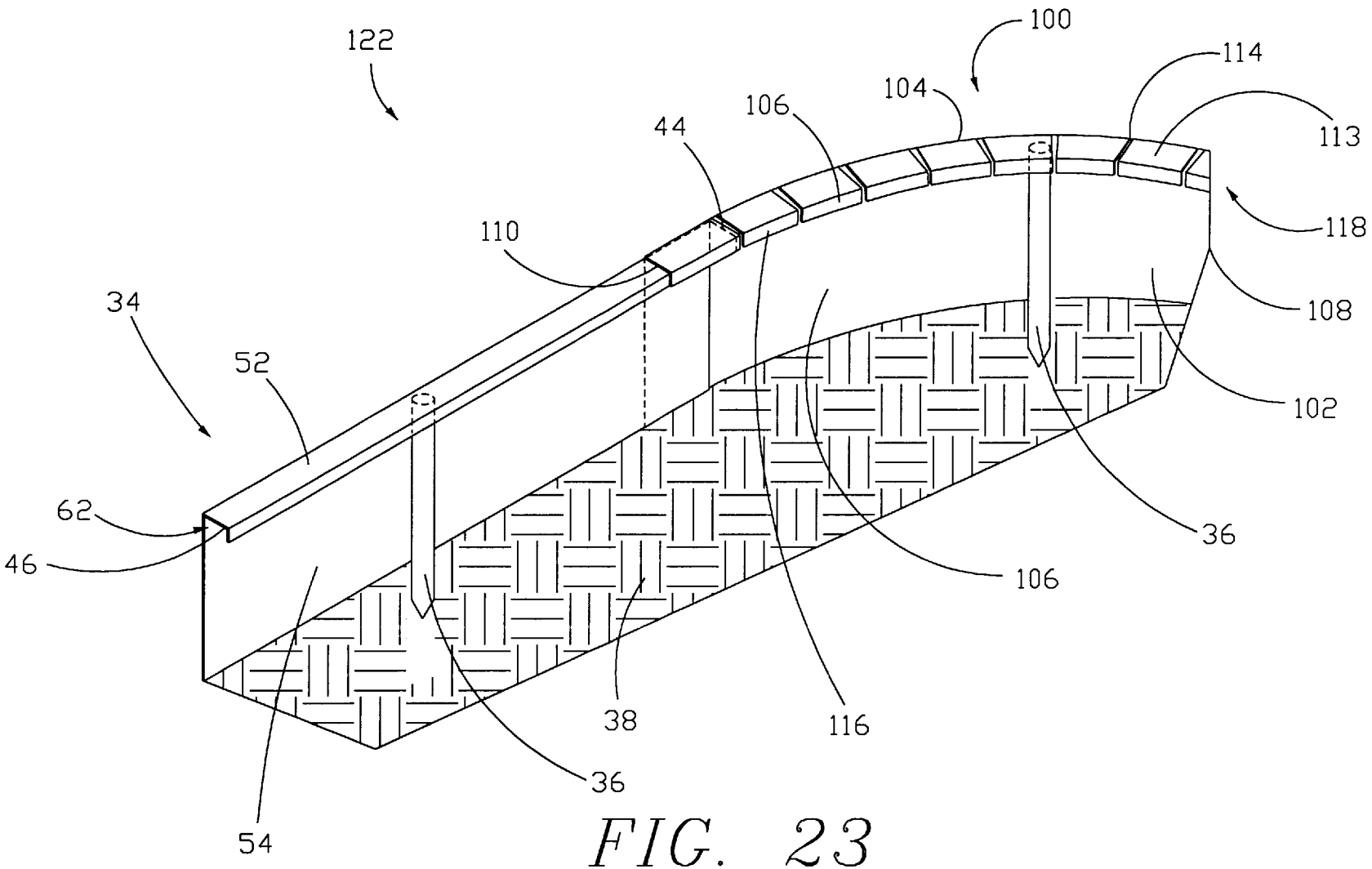
FIG. 23 shows a perspective view of an assembly of the present invention with a radius concrete form member.

While it is not necessary to use the radius form member 100 with an assembly, it may be used with a radius forming assembly 122 similar to either the first longitudinal form member 32 or the second longitudinal form member 34. A radius form member 100 with a wider inverted U-shaped channel 118, when used as part of a radius forming assembly 122, as shown in FIG. 23, overlaps a second longitudinal form member 34. In other words, the inverted U-shaped channel 62 on the second end 46 of the second longitudinal form member 34 is received within the inverted U-shaped channel 118 on the first end 108 of the radius form member 100, so that the combination of form members may be slidably extended or retracted for length by varying the amount of longitudinal overlap, and so that the radius form member 100 may be lifted off of the second longitudinal form member 34. Either before or after this overlap is achieved, the radius form member 100 may then be flexed to form an inward or an outward bend (see FIGS. 21–23). Alternatively, a radius form member 100 with a narrower inverted U-shaped channel 118 may be received within the U-shaped channel of the first longitudinal form member 32, so that the first longitudinal form member 32 may be lifted off of the radius form member 100. Similarly, the radius form member 100 as part of the radius forming assembly may be flexed to form either an inward or an outward bend. The radius form member 100 also, if necessary, receives a ground engaging member 36 within the inverted U-shaped channel 118 as part of the assembly 122. This ground engaging member 36 is also in contact with the ground 38. It is further contemplated that two or more radius form members 100 could be used to form the assembly 122, as opposed to a single radius form member 100 in combination with one of the first 32 or second 34 longitudinal form members.

Figure 24:
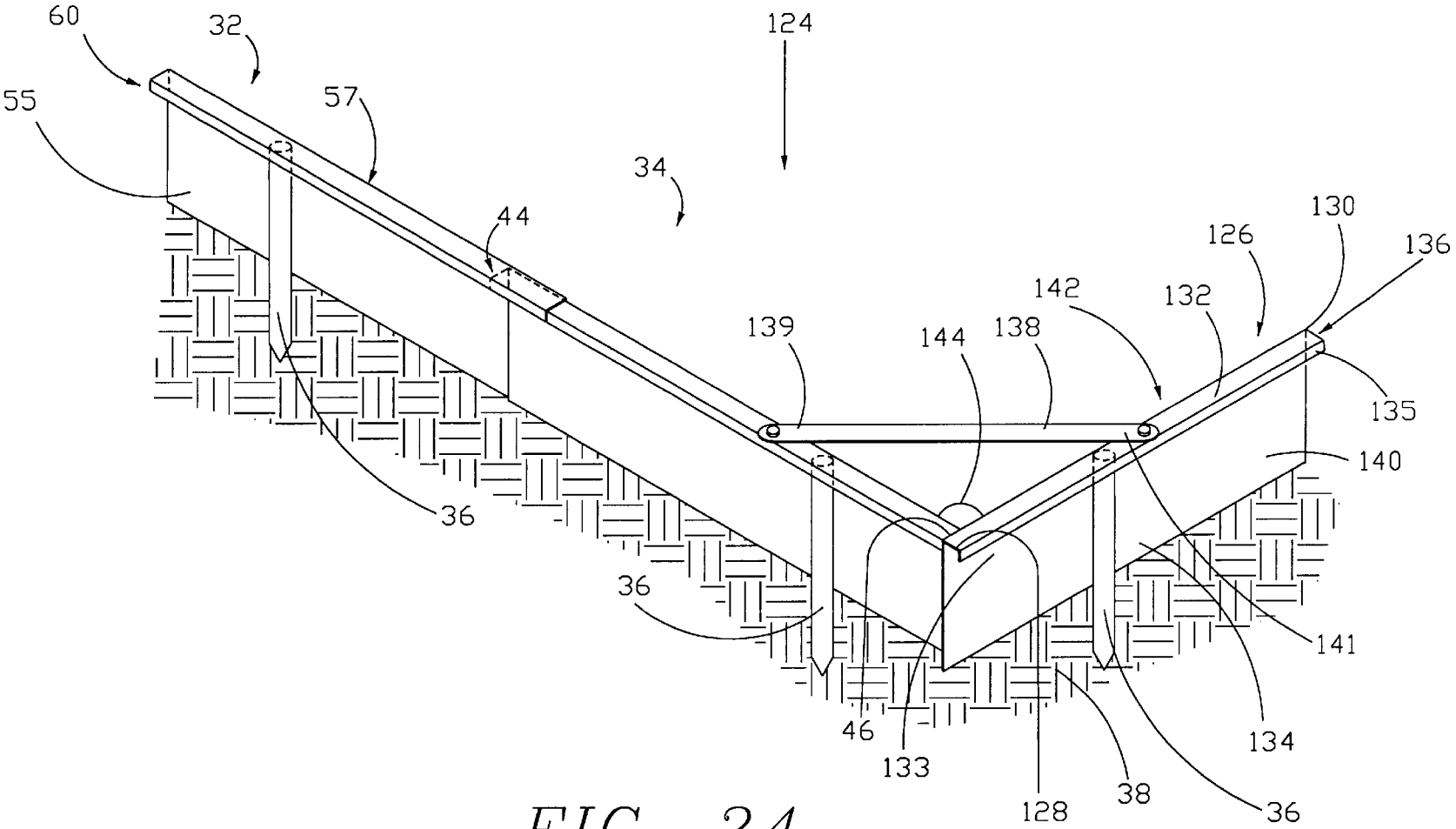
FIG. 24 shows a perspective view of an assembly of the present invention, with the addition of a third concrete form member angled away from the second concrete form member and a corner bar extending from the second concrete form member to the third concrete form member, forming an outside corner.

In preparing an assembly of concrete forms to create a cavity within which to place concrete, it is often necessary to provide corners, or sharp angles, as opposed to curves that are provided by radius forms. In doing so, it is helpful to have a means by which the angle is maintained throughout the assembly of the frame or creation of the cavity, and throughout the placement of the concrete within the cavity. Therefore with the present invention is provided a means of maintaining an angle. In particular, as shown in FIG. 24, a corner forming assembly 124 is provided with a first longitudinal form member 32 slidably overlapping a second longitudinal form member 34 and ground engaging members 36, as in the concrete form assembly 30 shown in FIG. 1. A third longitudinal form member 126 is also provided which is angled away from the first 32 and second 34 longitudinal form members. In a preferred embodiment the third longitudinal form member 126 is oriented substantially perpendicular to the first 32 and second 34 longitudinal form members. Furthermore, ground engaging members 36, if necessary, support the third longitudinal form member 126 and are in contact with the ground 38. Additionally, a corner forming bar 138, with a first end 139 and a second end 141, extends from the second longitudinal form member 34 to the third longitudinal form member 126. The first end 139 of the corner forming bar 138 engages the second longitudinal form member 34, while the second end 141 of the corner forming bar 138 engages the third longitudinal form member 126. This corner forming bar 138 is of a sufficient length so that an angle 144 is maintained between the second longitudinal form member 34 and the third longitudinal form member 126. Furthermore, the corner forming bar 138 may be attached to the second 34 and third 126 longitudinal form members by any means known in the art, and can be made of any material known in the art, so long as it is acceptable for the purposes provided.

The third longitudinal form member 126 in the preferred embodiment, is the equivalent of the first 32 and second 34 longitudinal form members, having a first end 128 and a second end 130, a generally vertical first frame element 135, a generally horizontal second frame element 132, a generally vertical third frame element 133, and a generally vertical fourth frame element 134. The second frame element 132 is integrally connected between the first 135 and third 133 frame elements so as to form an inverted U-shaped channel 136. The fourth frame element 134 extends axially below the third frame element 133. Depending upon the width of the inverted U-shaped channel 136 of the third longitudinal form member 126, this third longitudinal form member 126 is the equivalent of either the first longitudinal form member 32 or the second longitudinal form member 34, allowing slideable overlapping of additional longitudinal form members and capable of receiving a ground engaging member 36 within its inverted U-shaped channel 136. As shown in FIG. 24, to form an outside corner the third longitudinal form member 126 is oriented, in a preferred embodiment, so that the first end 128 of the third longitudinal form member 126 is in contact with the second end 46 of the second longitudinal form member 34 and so the outside angle 144 is formed on the face 57 of the forming component 55 facing the concrete of the second longitudinal form member 34 and the face 142 of the forming component 140 of the third longitudinal form member 126 facing the concrete. Therefore, the inverted U-shaped channels of each form 60, 62, 136 extend away from the outside angle 144 and the cavity 146 for the concrete. It is further contemplated that the second 34 and third 126 longitudinal form members contact at any point, not exclusively the ends 46, 128, so long as an angle is maintained between the two longitudinal form members.

Figure 25:
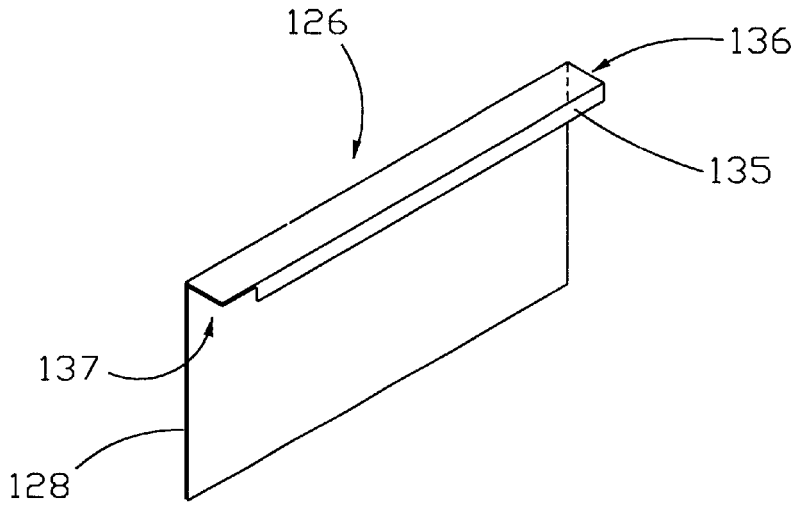
FIG. 25 shows a perspective view of a concrete form member with a notch for forming an inside corner.
Figure 26:
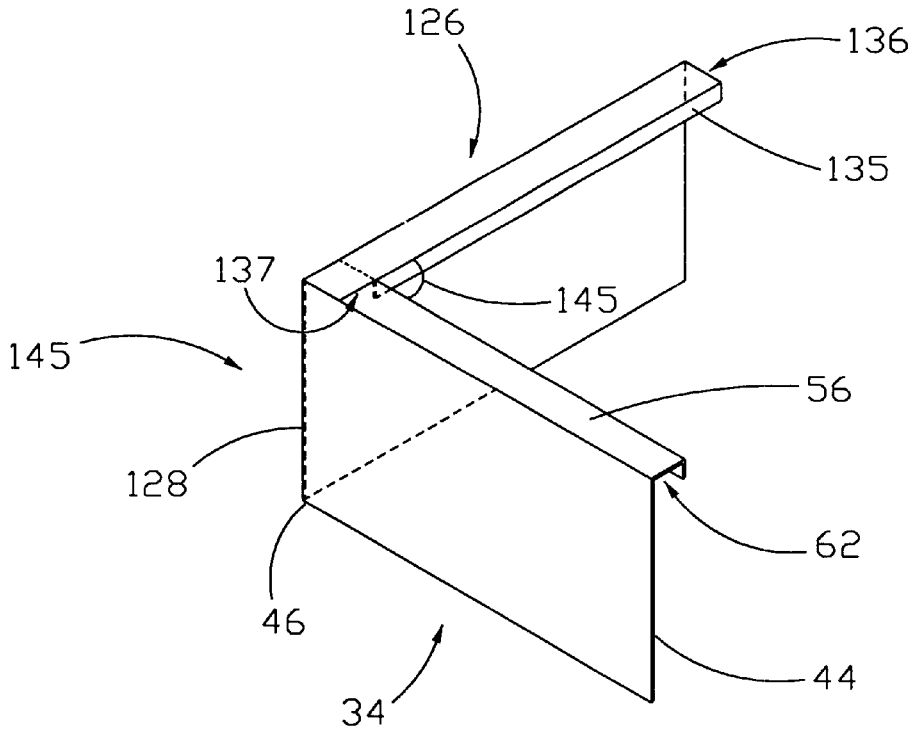
FIG. 26 shows a perspective view of an inside corner.

As shown in FIG. 26, in a preferred embodiment for the creation of an inside corner, either the second longitudinal form member 34 or the third longitudinal form member 126 is provided with a notch 137 in the inverted U-shaped channel 62, 136 at the end of one of the longitudinal form members 46, 128 (FIG. 25) forming the inside angle 145. The longitudinal form member without the notch is inserted into the notch 137, so that the first end 128 of the third longitudinal form member 126 is flush with the second end 46 of the second longitudinal form member 34 and the inverted U-shaped channels 60, 62, 136 extend toward the inside angle 145 and away from the cavity for the concrete.

The notch 137 of the inverted U-shaped channel 62, 136 is a location on the inverted U-shaped channel 62, 136 in which a section of the downward extension or first vertical frame element 59, 135 of the inverted U-shaped channel is absent. Typically, the absence of the downward extension 135 is the equivalent width of the horizontal component or second horizontal frame element 56, 132 of the second horizontal frame element which is inserted into the notch 137. However, any width greater than the width of the horizontal component may be used.

Alternative embodiments and combinations may be used with the corner forming bar 138. For example, it is contemplated that other longitudinal form members could be used, such as a form with an inverted L-shaped cross-section. Additionally, the corner may be formed between the first 32 and third 126 longitudinal form members or even by the use of only two longitudinal form members, as opposed to three. In a preferred embodiment, an angle 144, 145 of ninety (90) degrees between the two longitudinal form members 34, 126 in contact with the corner forming bar 138 is preferred. However, it is contemplated that any angle could be maintained using the corner forming bar 138 simply by adjusting the placement or length of the corner forming bar 138.

Figure 6:
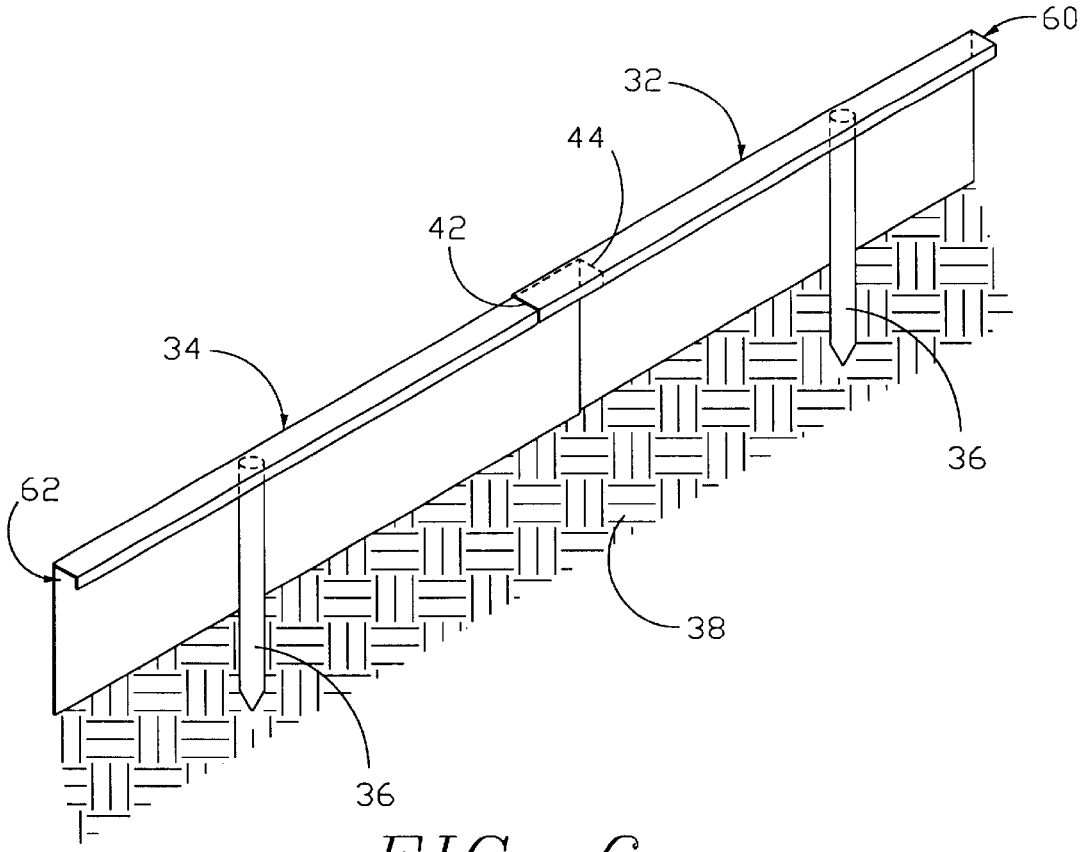
FIG. 6 shows a perspective view of the assembly of the present invention, with first and second concrete form members in an extended position.
Figure 7:
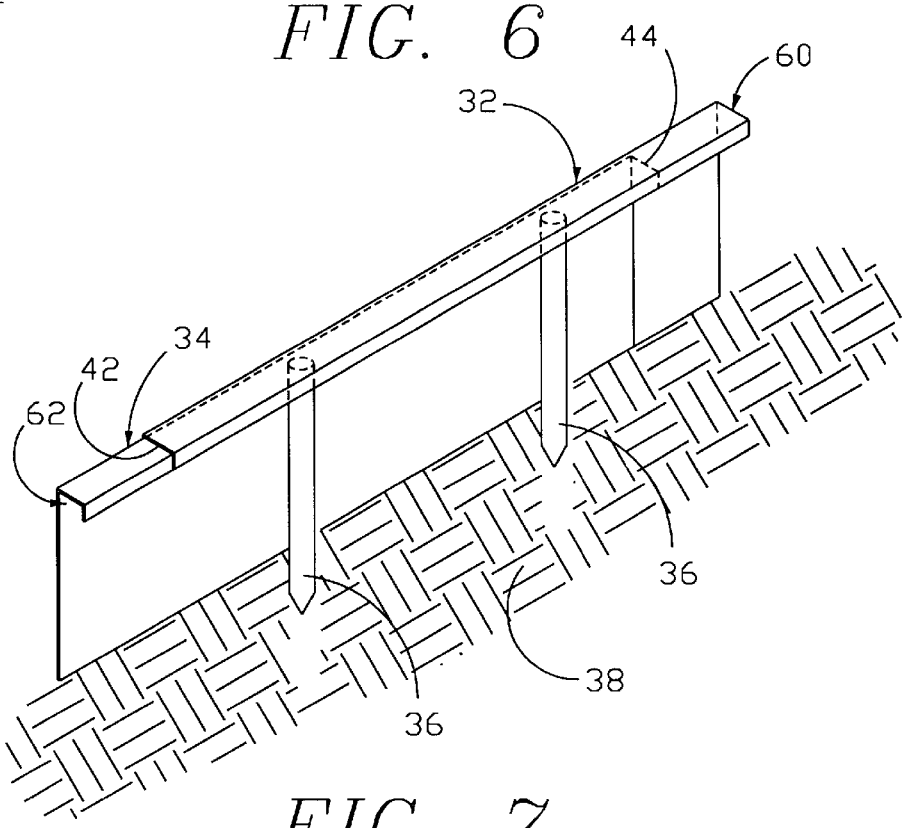
FIG. 7 shows a perspective view of the assembly of the present invention, with first and second concrete form members in a retracted position.

The method of making a concrete form assembly for use in the placement of concrete using the present invention further illustrates the ease and usefulness of the concrete form assembly 30. In making the assembly 30, first lines are marked from a first point to a second point, as is common in the art. For example, a string line could be used to mark off the location where the concrete forms are to be placed (not shown). Secondly, the ground engaging members 36 are spaced along this line and the ground engaging end 70 of the ground engaging member 36 is set in contact with the ground 38 (FIG. 1). In the case of a stake, the stake would be driven into the ground. These ground engaging members 36 can be placed at any point along this line to accommodate for variations in terrain and other obstacles. Third, the second longitudinal form member 34 is placed in contact with form engaging end 72 of the ground engaging member 36 (FIGS. 1 & 2). The form engaging end 72 of the ground engaging member 36 is received within a second inverted U-shaped channel 62 of the second longitudinal form member 34. As a result, the second longitudinal form member 34 hangs from the ground engaging member 36 (FIG. 2). Then, the first longitudinal form member 32 is placed in contact with the second longitudinal form member 34, so that a second inverted U-shaped channel 62 of the second longitudinal form member 34 is received within a first inverted U-shaped channel 60 of the first longitudinal form member 32 (FIGS. 2 & 5). The first longitudinal form member 32 can therefore partially (FIG. 6) or substantially (FIG. 7) overlap the second longitudinal form member 34. The first longitudinal form member 32 may be lifted off of the second longitudinal form member 34 and readjusted to accommodate the length of the frame necessary (FIG. 8), or the longitudinal form members 32, 34, due to their overlapping nature, may be slid together or apart, extending or retracting, to accommodate the same task (FIGS. 6 & 7).

The assembly as just described is sufficient for the placement of concrete. However, if further security of the longitudinal form members is desired, a ground engaging member 36 with a guide slot 74 and locking mechanism 76 may be used (FIG. 5). In this embodiment, the guide slot 74 receives either the first longitudinal form member 32, the second longitudinal form member 34, or both longitudinal form members 32, 34. The locking mechanism 76 is then tightened to secure the longitudinal form member in place (FIG. 14).

Figure 27:
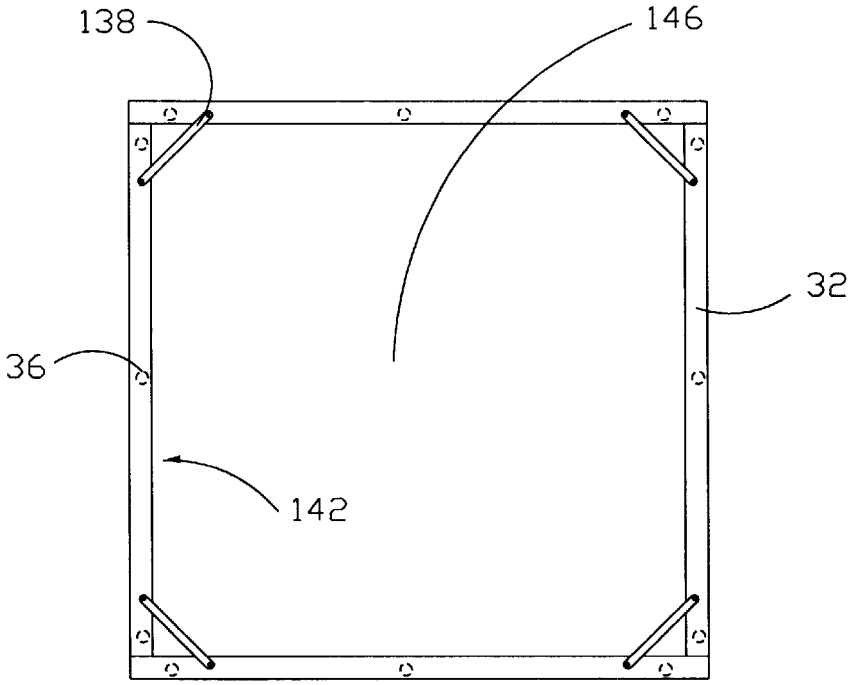
FIG. 27 shows a top elevational view of the concrete form members connected so as to form a cavity within the forms.
Figure 28:
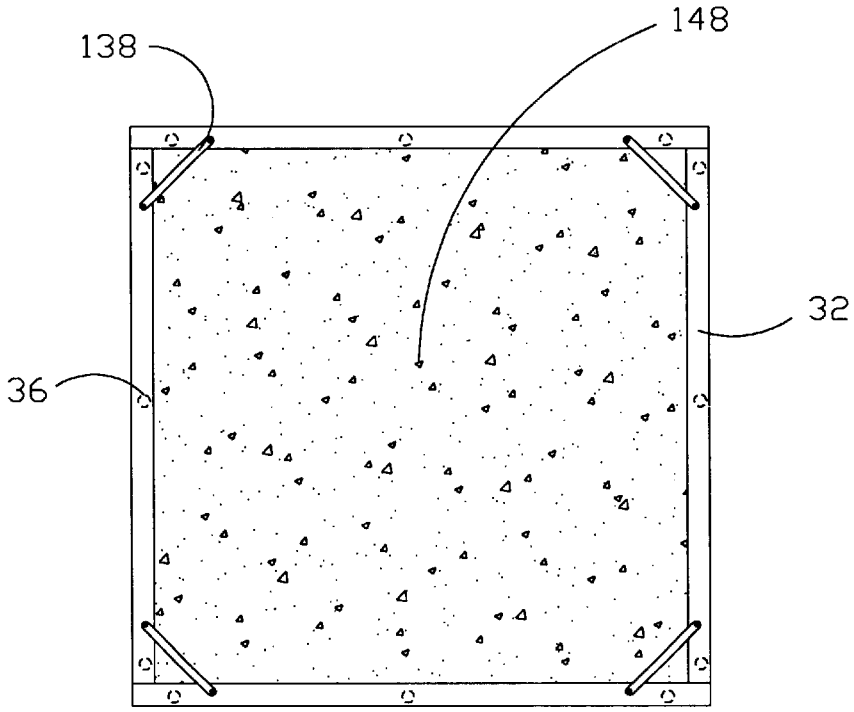
FIG. 28 shows the cavity of FIG. 24 with the addition of concrete placed into the cavity.

Once a first concrete form assembly is created by either method discussed, additional longitudinal form members, ground engaging members, angles, and radius form members may be added to create a frame or cavity 146. Further, an opposing barrier also must be present (FIG. 27) to provide a cavity 146 for the placement of concrete within the completed assembly. The concrete 148 is then placed within the cavity 146 (FIG. 28).

The assembly of concrete forms of the present invention is adaptable to fit a wide variety of frame or cavity shapes and sizes and can be interchanged with a wide variety of components.

The embodiments shown are especially well suited for quick and easy assembly and disassembly of the concrete form assembly on the job site, and for compact storage and transport to the site. However, the invention is in no way so limited. For instance, it would be obvious to modify the invention to create interlocking components which secure the form members to each other and to the ground engaging members. It would also be obvious to include any combination of form members and ground engaging members provided.

The foregoing description and drawings merely explain and illustrate preferred embodiments of the invention, and the invention is not limited thereto, except insofar as the claims are so limited. Those skilled in the art, who have the disclosure before them, will be able to make modifications and variations therein without departing from the scope of the invention. For example, while ground engaging members 36 are used to suspend the longitudinal form members 32, 34 in place, it is contemplated that other means could be used to hold the longitudinal form members in place, and contemplated that the longitudinal form members could be placed directly in contact with the ground.

What is claimed is:

1. An assembly for concrete forms for use in the placement of concrete, in which the concrete forms are light weight and capable of being stacked in a compact fashion, the assembly comprising:

a. at least one longitudinal form member having a single inverted U-shaped channel;

b. at least one radius form member having a single slotted inverted U-shaped channel with at least one spaced apart slot, said radius form member capable of being bent to form a radius;

c. a ground engaging member having a first end in contact with the ground and a second end vertically disposed opposite said first end;

d. at least one of said longitudinal and radius form members hung from said second end of said ground engaging member, said contact between said form member and said second end of said ground engaging member occurring at said inverted channel of said form member;

e. at least one of said longitudinal and radius form members overlapped and hung from said form member in contact with said second end of said ground engaging member, said contact between said longitudinal and radius form members occurring at said inverted channel, wherein one of said longitudinal and radius form members can be removed from said assembly without sliding said form members apart, and whereby the combination of said overlapping longitudinal and radius form members may be adjusted for length by varying the amount of longitudinal overlap.

2. The assembly for concrete forms of claim 1, in which said ground engaging member is a stake.

3. The assembly for concrete forms of claim 2, in which said stake is of uniform construction and comprises:

i. a ground engaging arm;

ii. an offset arm integrally connected to said ground engaging arm; and iii. a form engaging arm integrally connected to said offset arm, said form engaging arm offset from said ground engaging arm, whereby the stake for use with a footing is formed.

4. The assembly for concrete forms of claim 1, in which said ground engaging member includes a guide slot and locking mechanism thereon for securing said first and second longitudinal form members in place.

5. The assembly for concrete forms of claim 4, in which said locking mechanism is selected from the group consisting of a bent rod, a screw, and a cam type lever.

6. The assembly for concrete forms of claim 1, in which said longitudinal form member has a stiffener attached.

7. The assembly for concrete forms of claim 1, further comprising:

i. a third form member angled away from said longitudinal and radius form members;

ii. a corner forming bar with a first end and a second end, said first end of said corner forming bar engaging one of said longitudinal form member and said radius form member, and said second end of said corner forming bar engaging said third form member, whereby an angle is maintained between one of said longitudinal and radius form members and said third form member.

8. The assembly for concrete forms of claim 7, in which at least one of said inverted channels of said form members contains at least one notch.

9. The assembly for concrete forms of claim 8, in which said angle is maintained by said end of said longitudinal form member without said notch being inserted into said notch.

10. A method of making a concrete form assembly comprising:

a. providing a longitudinal form member having a single inverted U-shaped channel;

b. providing a radius form member having a single slotted inverted U-shaped channel with at least one spaced apart slot;

c. providing a ground engaging member having a first end in contact with the ground, and a second end vertically disposed opposite the first end;

d. placing said first end of said ground engaging member in contact with the ground;

e. placing said inverted U-shaped channel of at least one of said longitudinal and said radius form members in contact with said second end of said ground engaging member, hanging said form member from said ground engaging member; and f. at least partially overlapping and hanging one of said longitudinal and radius form members over said form member in contact with said ground engaging member, wherein said overlapped longitudinal form member can be removed from said assembly without sliding said form members apart, whereby the combination of said longitudinal and radius form members may be adjusted for length by varying the amount of longitudinal overlap, and said overlapping form member may be lifted off for disassembling the assembly.

11. A method of making a concrete slab comprising the steps of claim 10 and the additional steps of providing an opposing barrier to create a cavity and placing concrete into said cavity.

* * * * *